US005276981A

United States Patent [19]

Schaffer et al.

[11] Patent Number: 5,276,981

[45] Date of Patent: Jan. 11, 1994

[54] DURABLE MATERIAL FOR OUTDOOR SHOE HEELS

[75] Inventors: Scott A. Schaffer, Chatsworth; Bret C. Schaffer, Huntington Beach, both of Calif.

[73] Assignee: Allan Schaffer, Woodland Hills, Calif.

[21] Appl. No.: 539,423

[22] Filed: Jun. 18, 1990

[51] Int. Cl.[5] ..... A43B 21/00

[52] U.S. Cl. ..... 36/34 R; 36/59 R; 12/142 Q

[58] Field of Search ..... 36/98, 134, 114, 31, 36/59; 523/139, 150, 445, 457; 12/142

[56] References Cited

U.S. PATENT DOCUMENTS

| | | | |
|---|---|---|---|
| 1,796,399 | 3/1931 | Roodhouse | 36/59 R |
| 2,710,463 | 6/1955 | Liska | 36/71.5 |
| 2,766,800 | 10/1956 | Rockoff | 36/59 R |
| 3,629,051 | 12/1971 | Mitchell | 36/59 R |
| 3,954,694 | 5/1976 | Hallstrom et al. | 36/59 R |
| 4,246,706 | 1/1981 | Persons, Jr. | 36/71.5 |
| 4,336,178 | 6/1982 | Heidingher et al. | 523/457 |
| 4,456,713 | 6/1984 | French et al. | 523/455 |
| 4,564,966 | 1/1986 | Chen | 36/31 |
| 4,920,663 | 5/1990 | Flemming | 36/75 R |

FOREIGN PATENT DOCUMENTS

| | | | |
|---|---|---|---|
| 2537291 | 2/1977 | Fed. Rep. of Germany | 12/142 Q |
| 1166710 | 7/1986 | Japan | 36/59 R |
| 2090182 | 4/1989 | Japan | 36/98 |
| 31576 | 8/1904 | Switzerland | 12/142 Q |
| 991995 | 2/1983 | U.S.S.R. | 36/59 R |
| 16632 | of 1905 | United Kingdom | 12/142 Q |

*Primary Examiner*—Steven N. Meyers

[57] ABSTRACT

A very long wearing material to replace regions that erode rapidly in the heels of outdoor shoes. The material is made by embedding relatively large, round, wear-resistant particles in a very hard urethane binder. Applications include both applying the material directly to the heel as a paste with curing in situ and casting in molds for attachment to the heel with an adhesive.

6 Claims, 1 Drawing Sheet

Fig. 1.
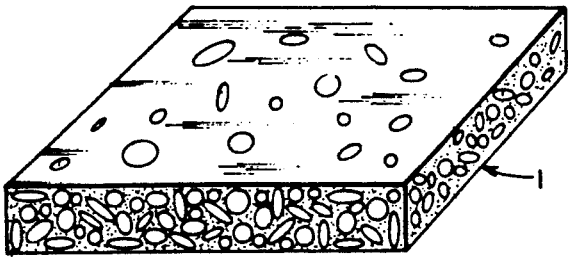
Fig. 2.
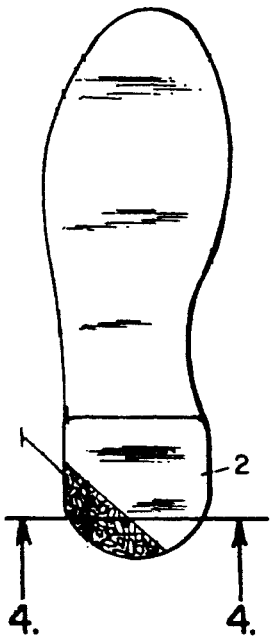
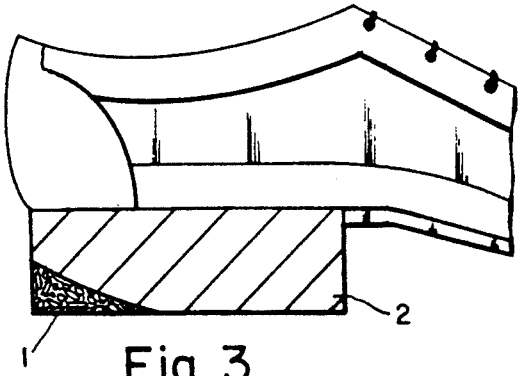
Fig. 3.
Fig. 4.
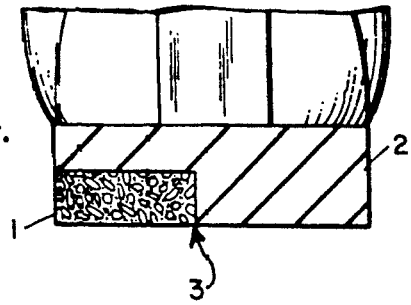

DURABLE MATERIAL FOR OUTDOOR SHOE HEELS

BACKGROUND OF THE INVENTION

1. Technical Field

This invention is concerned with preventing premature heel wear on outdoor shoes.

2. Related Art

U.S. Pat. No. 4,564,966 to Chen relates to improving sole and heel wear through the use of molded studs made of rubber or plastic having high carbon content.

Japan Pat. No. 1,166,710 to Fujiyoshi relates to a nonslip material composed of a rubber or resin body with embedded hard porous material.

U.S. Pat. No. 4,779,360 to Bible relates to a nonskid sole incorporating granular particles of sufficient hardness to furrow a slippery surface. a slippery surface.

U.S. Pat. No. 3,573,155 to Mitchell relates to a nonslip material composed of a rubber-like mass impregnated with aluminum shavings.

U.S. Pat. No. 3,954,694 to Hallstrom et al relates to composition used as a coating on the surfaces of machinery and fluid systems to reduce abrasive wear.

The commercially available products to increase heel life are of three types: viscous adhesives that harden after application, glue-on plastic taps, and nail-on metal taps.

SUMMARY OF THE INVENTION

This invention solves the problem of rundown heels on outdoor shoes by embedding relatively large, wear-resistant, round particles in a very hard urethane binder. The composite material replaces the wearing region of the heel. There are two embodiments. In one, the selected urethane is of the paste type, and the material bonds itself to the heel during the curing process. In the other, the urethane is of the castable type, and the material is first molded into taps which, after curing, are bonded to the heel with an adhesive.

BRIEF DESCRIPTION OF THE DRAWINGS

FIG. 1 is a cross-section view of the composite material.

FIG. 2 is a plan view showing the material attached to a heel.

FIG. 3 is a cross-section view showing the material applied to a worn heel.

FIG. 4 is a cross-section view showing the material built into a new heel.

DESCRIPTION OF THE PREFERRED EMBODIMENT

Many runners wear down the outside of their shoe heels prematurely, particularly heel strikers who jog on hard pavement. For severe heel strikers, there exists no material in the related art that will last for as much as 100 miles of pavement pounding. Since the remainder of the shoe can be expected to last from 500 to 1000 miles, there is need for a means to allow the heel to do as well.

To aid in understanding why this problem has not been solved, it is useful to consider an equivalent dynamic situation that is more easily visualized. It is known that a runner strikes hard surfaces with a force of between 2 and 3 times his weight. For a 170 pound runner the impact is roughly equivalent to dropping a 400 pound weight onto the outside rear of the heel from a height of 1.5 feet. If the heel is to achieve 1000 miles of wear, than the 400-pound weight must impact and scrape over the heel about 750,000 times.

The object of this invention is a material that can replace the high wear region in the heels of outdoor shoes and endure from 500 to 1000 miles of pavement pounding. The elements of the solution involve four parameters (1) a polymer-type binder in which is embedded (2) substantially spherical war-resistant particles with (3) means for ensuring that the binder retains the particles under load and (4) means for ensuring that the ensemble remains attached to the heel. FIG. 1 shows the material 1 is a typical layer. 2 are the particles. 3 is the binder. The prime function of the particles is to resist wear. The prime function of the binder is to hold the particles in place. Through many thousands of moles of road testing, a successful combination of the above four parameters has been found. Moreover tests have shown that apparently modest variations in the parameters can ruin the solution. These results will be explained herein to illuminate the unique nature of this invention.

Starting with the binder, the most important characteristics are that it hold the wear-resistant particles in place under the high impact loads that occur when the heel strikes pavement and that it not crack excessively so as to fatigue under the repetitive stresses. Relatively flexible materials such as rubber, or the polyurethanes normally used in shoe soles, are not strong enough to hold the particles in place. Epoxies will anchor the particles satisfactorily, but epoxies will fatigue and crack long before 500 miles even if grooved to aid flexibility. Only very hard polyurethanes have proved satisfactory—in particular those characterized by having a hardness greater than about 50 on the Shore D scale. This type of material is singular in that it has both the strength to retain the particles and the toughness not to suffer fatigue failure under the repetitive conditions described. These properties are not exhibited simultaneously by the other principal candidate binders, namely epoxies and conventional softer polyurethanes. Epoxies have the strength to hold the particles in place but not the toughness to resist fracture under the impact loads. Conventional polyurethanes have the toughness not to fracture but lack the requisite strength. Only the hard polyurethanes have both necessary properties.

With regard to the particles, the principal requirements are that they be very resistant to abrasive wear and that they not fracture under the repeated heavy impacts. The first requirement is satisfied by high density materials having a hardness of at least 9 on the Mohs scale, typical of several abrasive and blast-type media. The second requirement dictates both a tough (non-brittle) material and a substantially spherical shape. The round shape is crucial since with irregular particles, excessive wear occurs because the sharp edges continually break off under impact. These requirements are met by at least one commercially available product, viz. aluminum oxide particles produced by pelletizing a powder prior to sintering.

Since urethanes unaided do not normally adhere well to materials like aluminum oxide, it is necessary to treat the particles with a primer such as a silane in order for the binder to adhere to them satisfactorily. The prospective binder and silane must be tested empirically and, if necessary, varied until a combination producing a sufficiently strong bond to the particles is found.

A further requirement is that the particles be relatively large. Tests have shown that particles which pass about a 20 mesh screen are ripped out of the binder under impact. The size should be in the range of about 8 to 16 mesh.

In the preferred embodiment for the configuration in FIGS. 2 and 3, the material is to be applied in the green state directly to a worn heel. 1 is the material and 2 is the worn heel. The area to receive the patch is roughened with an abrasive paper and then treated with a primer such as Devcon "FL20" which promotes the adhesion of urethane to rubber-like materials. The particles are "Sinter Ball" from U.S. Mineral, Inc. "Sinter Ball" is an inexpensive, pelletized and sintered, blast-type media made from 80% corundum (aluminum oxide), 10% mullite, and 10% spinels. It has a Mohs hardness of 9 and a crush strength of 12,500 psi. The mesh size of the particles is a random assortment between 8 and 16. The particles have previously been primed with Dow Corning "6020" silane diluted with methyl alcohol. The binder is Hexel "3159 Uralite" two-component paste-type urethane adhesive.

The two components of the urethane are first combined and then the "Sinter Ball" particles are added so as to produce a uniform mixture having a packing factor of about 45%. Although useful results can be obtained for packing factors anywhere between about 25% to 55% the optimum is approximately 45%. The consistency of the green mixture is that of a thick paste. With the shoe sole facing upward, the mixture is applied to the worn area with a spatula and formed to the desired shape. It is then allowed to set for approximately eight hours prior to use.

In the preferred embodiment for the configuration of FIG. 4, the material is first cast to the desired shape in a mold and cured therein. It is then glued to the heel area. 1 is the molded tap, 2 is the heel, and 3 is the adhesive. The procedure is otherwise similar to that already described except that the binder is Hexel "3500 Uralite" two-component castable urethane. A suitable glue for attaching the cast tap to the heel area is 3M "Pronto CA40H" cyanoacrylate.

Although the foregoing discussion has focused on replacing the worn regions in a runner's heel, the same embodiments can obviously be incorporated into the heels of new shoes to prevent wear.

The techniques described in this patent can also be applied to regions of the sole other than the heel. Even longer wear will generally result in these regions because they are usually stressed much less than the heel.

We claim:

1. A material for replacing the high wear regions in the heels of outdoor shoes wherein high density wear-resistant particles of substantially spherical shape and approximate mesh 8 to 16 are embedded in a two-component urethane binder having a hardness in excess of approximately 50 on the Shore D scale.

2. The material of claim 1 wherein the particles are comprised principally of aluminum oxide.

3. A material for replacing the high wear regions in the heels of outdoor shoes wherein high density wear-resistant particles of substantially spherical shape and approximate mesh 8 to 16 are embedded in a paste-type two-component urethane binder having a hardness in excess of approximately 50 on the Shore D scale.

4. The material of claim 3 wherein the particles are comprised principally of aluminum oxide.

5. A material for replacing the high wear regions in the heels of outdoor shoes wherein high density year-resistant particles of substantially spherical shape and approximate mesh 8 to 16 are embedded in a castable liquid-type two-component urethane binder having a hardness in excess of approximately 50 on the Shore D scale.

6. The material of claim 5 wherein the particles are comprised principally of aluminum oxide.

* * * * *

UNITED STATES PATENT AND TRADEMARK OFFICE

CERTIFICATE OF CORRECTION

PATENT NO. : 5,276,981

DATED : Jan. 11, 1994

INVENTOR(S) : Scott A. Schaffer, et al.

It is certified that error appears in the above-indentified patent and that said Letters Patent is hereby corrected as shown below:

On the title page, item [75] should read as follows:
Scott A. Schaffer, Chatsworth; Bret C. Schaffer, Huntington Beach; Allan Schaffer, Huntington Beach, all of Calif.

Signed and Sealed this

Thirteenth Day of September, 1994

*Attest:*

Bruce Lehman

BRUCE LEHMAN

*Attesting Officer*

*Commissioner of Patents and Trademarks*